United States Patent [19]

Sugasawa

[11] 4,365,598

[45] Dec. 28, 1982

[54] INTERNAL COMBUSTION ENGINE

[75] Inventor: Fukashi Sugasawa, Yokohama, Japan

[73] Assignee: Nissan Motor Company, Limited, Yokohama, Japan

[21] Appl. No.: 234,901

[22] Filed: Feb. 17, 1981

[30] Foreign Application Priority Data

Feb. 20, 1980 [JP] Japan ..... 55-20019

[51] Int. Cl.[3] ..... F02D 17/02

[52] U.S. Cl. ..... 123/198 F

[58] Field of Search ..... 123/198 F

[56] References Cited

U.S. PATENT DOCUMENTS 3,174,470 3/1965 Von Seggern et al. .
3,192,706 7/1965 Dolza .
4,192,278 3/1980 Iizuka et al. .

FOREIGN PATENT DOCUMENTS 2853455 6/1979 Fed. Rep. of Germany .
2037370 7/1980 United Kingdom ..... 123/198 F
2066356 7/1981 United Kingdom ..... 123/198 F

*Primary Examiner*—Wendell E. Burns
*Attorney, Agent, or Firm*—Schwartz, Jeffery, Schwaab, Mack, Blumenthal & Koch

[57] ABSTRACT

An internal combustion engine is disclosed which includes an induction passage divided into first and second intake passages leading to first and second groups of cylinders, respectively. The second intake passage has at its entrance a stop valve which closes to disconnect the second group of cylinders from the induction passage when the engine load is below a predetermined value. Main fuel supply means supplies a controlled amount of fuel into the induction passage. Auxiliary fuel supply means is provided for supplying a predetermined amount of fuel into the second intake passage downstream of the stop valve for a predetermined period of time after the engine load exceeds the predetermined value.

6 Claims, 3 Drawing Figures

INTERNAL COMBUSTION ENGINE

BACKGROUND OF THE INVENTION

1. Field of the Invention

The present invention relates to improvements in a split type multicylinder internal combustion engine operable on less than all of its cylinders when the engine load is below a given value.

2. Description of the Prior Art

It is known that to increase the efficiency of a multicylinder internal combustion engine, the number of cylinders on which the engine operates under predetermined engine operating conditions can be reduced, particularly under conditions of low engine load. For this purpose, control means are provided which disable a number of cylinders in a multicylinder internal combustion engine by blocking the flow of air-fuel mixture to certain cylinders under low load conditions. The disablement of some of the cylinders of the engine increases the load on those remaining in operation and, as a result, the energy conversion efficiency is increased. It is common practice to block the flow of an air-fuel mixture to certain cylinders by closing a stop valve provided at the entrance of an intake passage which is connected to the certain cylinders and separated from the intake passage leading to the remaining cylinders.

One difficulty with such conventional split multicylinder internal combustion engines is that after the engine load exceeds a predetermined value and the stop valve opens, the disabled cylinders are held inoperative for the relatively long time it takes for the air-fuel mixture to reach the disabled cylinders through the associated intake passage. The result is poor engine acceleration performance.

The present invention provides an improved split multicylinder internal combustion engine which exhibits high engine performance particularly under acceleration with a greatly reduced time during which the engine operation is shifted from its split engine mode into its full engine mode after the engine load exceeds a predetermined value.

SUMMARY OF THE INVENTION

The present invention provides an internal combustion engine which includes first and second cylinder units each including at least one cylinder; an induction passage having therein a throttle valve, the induction passage being divided, downstream of the throttle valve, into first and second intake passages leading to the first and second cylinder units, respectively; a normally open stop valve is provided at the entrance of the second intake passage, and a control means responsive to conditions of engine load for closing the stop valve to disconnect the second intake passage from the induction passage when the engine load is below a predetermined value. A main fuel supply unit supplies a controlled amount of fuel into the induction passage. An auxiliary fuel supply unit is provided for supplying a predetermined amount of fuel into the second intake passage downstream of the stop valve for a predetermined period of time after the engine load exceeds the predetermined value.

The auxiliary fuel supply unit may comprise auxiliary fuel injection valve means opening into the second intake passage downstream of the stop valve. In this case, the control means is adapted to control the operation of the auxiliary fuel injection valve means to supply a predetermined amount of fuel for a predetermined period of time after the engine load exceeds the predetermined value.

Alternatively, the auxiliary fuel supply unit may comprise fuel injection nozzle means opening into the second intake passage downstream of the stop valve, the fuel injection nozzle means being connected through an auxiliary fuel passage to a fuel reservoir, and a fuel pump being provided in the auxiliary fuel passage for discharging a predetermined amount of fuel to the fuel injection nozzle means for a predetermined period of time after the engine load exceeds the predetermined value.

In a preferred embodiment, the fuel pump comprises a bellows having therein a deformable chamber communicated with the auxiliary fuel passage, and a pair of check valves provided in the auxiliary fuel passage downstream and upstream of the bellows. The bellows is drivingly connected to the stop valve to increase the volume of the chamber with the closing movement of the stop valve and to reduce the volume of the chamber with the opening movement of the stop valve.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

BRIEF DESCRIPTION OF THE DRAWINGS

The present invention will be described in greater detail by reference to the following description taken in connection with the accompanying drawings, in which.

DESCRIPTION OF THE PREFERRED EMBODIMENTS

Figure 1:
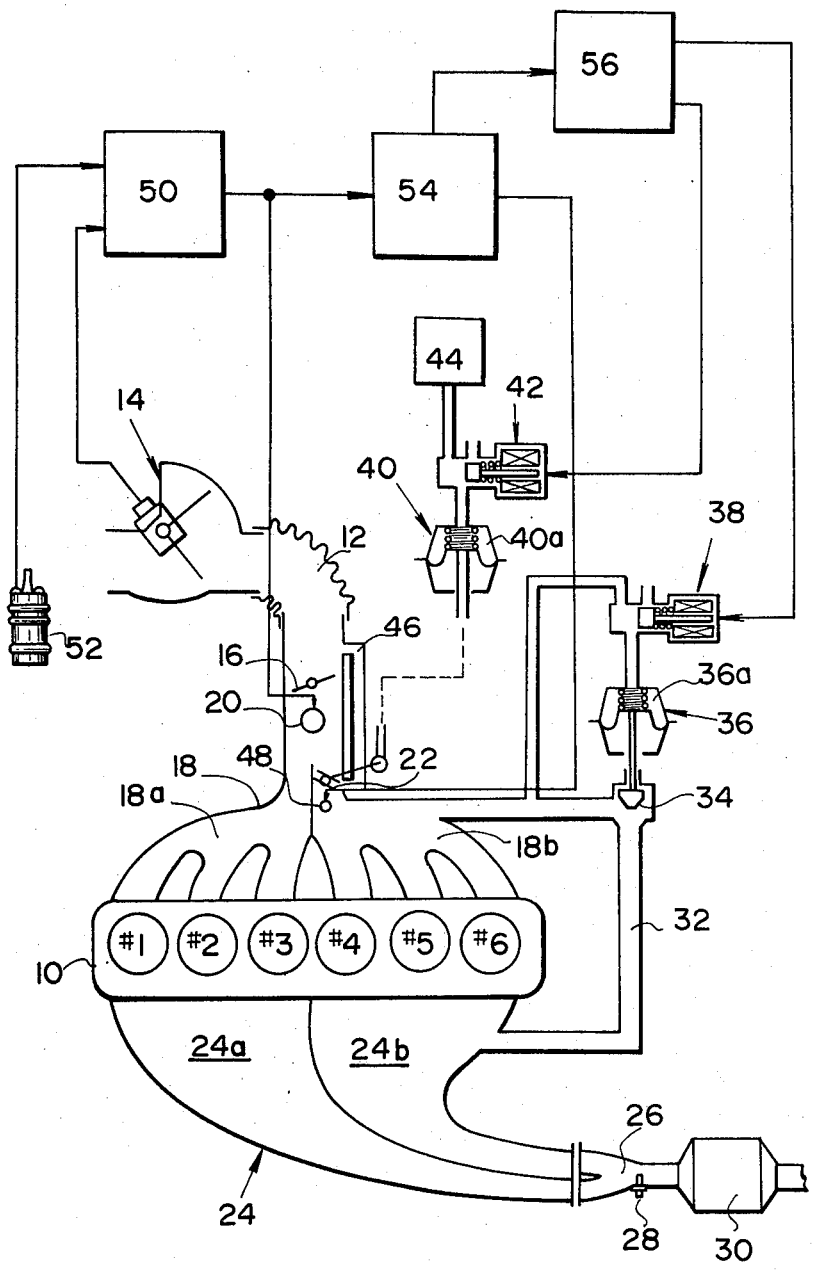
FIG. 1 is a schematic sectional view showing one embodiment of a split multicylinder internal combustion engine made in accordance with the present invention.

Referring now to FIG. 1, there is illustrated one embodiment of a split internal combustion engine made in accordance with the present invention. The engine is shown as a 6-cylinder engine having an engine block 10 which contains an active cylinder unit including three cylinders #1 to #3 being always active during engine operation and an inactive cylinder unit having three cylinders #4 to #6 being inactive under low load conditions.

Air to the engine is introduced through an induction passage 12 provided therein with an airflow meter 14 and a throttle valve 16. The throttle valve 16 is drivingly connected to the accelerator pedal (not shown) for controlling the flow of air to the engine. The induction passage 12 is connected downstream of the throttle valve 16 to an intake manifold 18 which is divided into first and second intake passages **18*a* and 18*b*. The first intake passage 18*a* leads to the cylinders #1 to #3, and the second intake passage 18*b* leads to the cylinders #4 to #6. A main fuel injection valve 20 is provided for supplying a controlled amount of fuel into the induction passage 12 somewhere downstream of the throttle valve 16. The second intake passage 18b has at its entrance a stop valve 22 adapted to close so as to block the supply of an air-fuel mixture through the second intake passage 18b** into the cylinders #4 to #6, thereby disabling them under low load conditions.

The engine also has an exhaust manifold 24 which is divided into first and second exhaust passages 24a and 24b. The first exhaust passage 24a leads from the cylinders #1 to #3, and the second exhaust passage 24b leads from the cylinders #4 to #6. The exhaust manifold 24 is connected at its downstream end to an exhaust duct 26 provided therein with an air/fuel ratio sensor 28 and an exhaust gas purifier 30. The air/fuel ratio sensor 28 may be in the form of an oxygen sensor which monitors the oxygen content of the exhaust and provides a signal indicative of the air/fuel ratio at which the engine is operating. The exhaust gas purifier 30 may be in the form of a three-way catalytic converter which effects oxidation of HC and CO and reduction of $NO_x$ so as to minimize the emission of pollutants through the exhaust duct 26.

The second exhaust passage 24b is connected to the second intake passage 18b through an exhaust gas recirculation (EGR) passage 32 having therein an EGR valve 34. The EGR valve 34 is adapted to open to permit exhaust gases to recirculate through the EGR passage 32 into the second intake passage 18b so as to minimize pumping losses in the inactive cylinders #4 to #6 during a split engine mode of operation wherein the engine operates only on the cylinders #1 to #3. The EGR valve 34 closes to prevent exhaust gas recirculation during a full engine mode of operation where the engine operates on all of the cylinders #1 to #6.

The EGR valve 34 is driven by a first pneumatic valve actuator 36 which includes a diaphragm spread within a casing to define therewith two chambers on the opposite sides of the diaphragm, and an operating rod movable to open and close the EGR valve 34 with the displacement of the diaphragm. The working chamber 36a is connected to a first port of a first three-way solenoid valve 38 which has a second port communicated with atmospheric air and a third port communicated with the second intake passage 18b. The first solenoid valve 38 is normally in a position providing communication between its first and second ports to introduce atmospheric pressure to the actuator working chamber 36a so as to close the EGR valve 34. During a split engine mode of operation, the first solenoid valve 38 moves to another position where communication is established between its first and third ports to introduce vacuum from the second intake passage 18b into the actuator working chamber 36a so as to open the EGR valve 34.

The stop valve 22 is driven by a second pneumatic valve actuator 40 which is substantially similar to the first valve actuator 36. The working chamber 40a of the second valve actuator 40 is connected to a first port of a second three-way solenoid valve. The solenoid valve 42 has a second port communicated with atmospheric air and a third port communicated with a vacuum tank 44. The second solenoid valve 42 is normally in a position providing communication between its first and second ports to introduce atmospheric pressure to the actuator working chamber 40a so as to open the stop valve 22. When the engine operation is in a split engine mode, the second solenoid valve 42 moves to another position providing communication between its first and third ports to introduce vacuum from the vacuum tank 44 into the actuator working chamber 40a so as to close the stop valve 22.

The stop valve 22 may be in the form of a double-faced butterfly valve having a pair of valve plates facing in spaced-parallel relation to each other. A conduit 46 is provided which has its one end opening into the induction passage 12 somewhere upstream of the throttle valve 16 and the other end thereof being in registry with the space between the valve plates when the stop valve 22 is in its closed position. Air, which is substantially at atmospheric pressure, is introduced through the conduit 46 into the space between the valve plates so as to ensure that the exhaust gases charged in the second intake passage 18b cannot escape into the first intake passage 18a when the stop valve 22 closes.

An auxiliary fuel injection valve 48 is provided which opens into the second intake passage 18b somewhere downstream of the stop valve 22. The operation of the auxiliary fuel injection valve 48 is controlled to supply a desired amount of fuel through the second intake passage 18b into the cylinders #4 to #6 for a predetermined period of time after the engine operation is changed from its split engine mode into its full engine mode.

The reference numeral 50 designates an injection control circuit which provides, in synchronism with engine rotation such as represented by spark pulses from an ignition coil 52, a fuel-injection pulse signal of pulse width proportional to the air flow rate sensed by the airflow meter and corrected in accordance with an air/fuel ratio indicative signal from the air/fuel ratio sensor 28 so as to ensure that the fuel supplied to the engine is correct to maintain a desired optimum air/fuel ratio.

The fuel-injection pulse signal is applied directly to the main fuel injection valve 20. The main fuel injection valve 20 may be in the form of an ON-OFF type solenoid valve adapted to open for a time period corresponding to the pulse width of the fuel-injection pulse signal so as to inject a controlled amount of fuel into the induction passage 12. The fuel-injection pulse signal is also applied to a split engine control circuit 54. The split engine control circuit 54 is adapted to determine the engine load at which the engine is operating from the pulse width of the fuel-injection pulse signal.

When the engine load is below a predetermined value, the split engine control circuit 54 holds the engine operation in its split engine mode by providing a control signal to a drive circuit 56 which thereby drives the second solenoid valve 42 to the postion providing communication between its first and third ports to introduce vacuum into the actuator working chamber 40a so as to close the stop valve 22 and also drives the first solenoid valve 38 to the position providing communication between its first and third ports to introduce vacuum into the actuator working chamber 36a so as to open the EGR valve 34.

In addition, the split engine control circuit 54 provides a fuel-injection signal to the auxiliary fuel injection valve 48 which thereby injects a desired amount of fuel into the second intake passage 18b downstream of the stop valve 22 for a predetermined period of time after the engine load exceeds the predetermined value at which the engine operation is to be changed from its split engine mode to its full engine mode. The period of time during which the auxiliary fuel injection valve 48 operates to supply a desired amount of fuel, corresponds to the time it takes the fuel supplied from the main fuel injection valve 20 to enter the cylinders #4 to #6 through the second intake passage 18*b*. Since the auxiliary fuel injection valve 48 is much closer to the cylinders #4 to #6 than the main fuel injection valve 20, the cylinders #4 to #6 can be supplied with an air-fuel mixture a much shorter time after the engine load exceeds the predetermined value, as compared to conventional arrangements. This permits a rapid change of the engine operation into its split engine mode into its full engine mode and provides improved engine acceleration performance. The auxiliary fuel injection valve 48 may be controlled such as to operate only when rapid engine acceleration is required.

Figure 2:
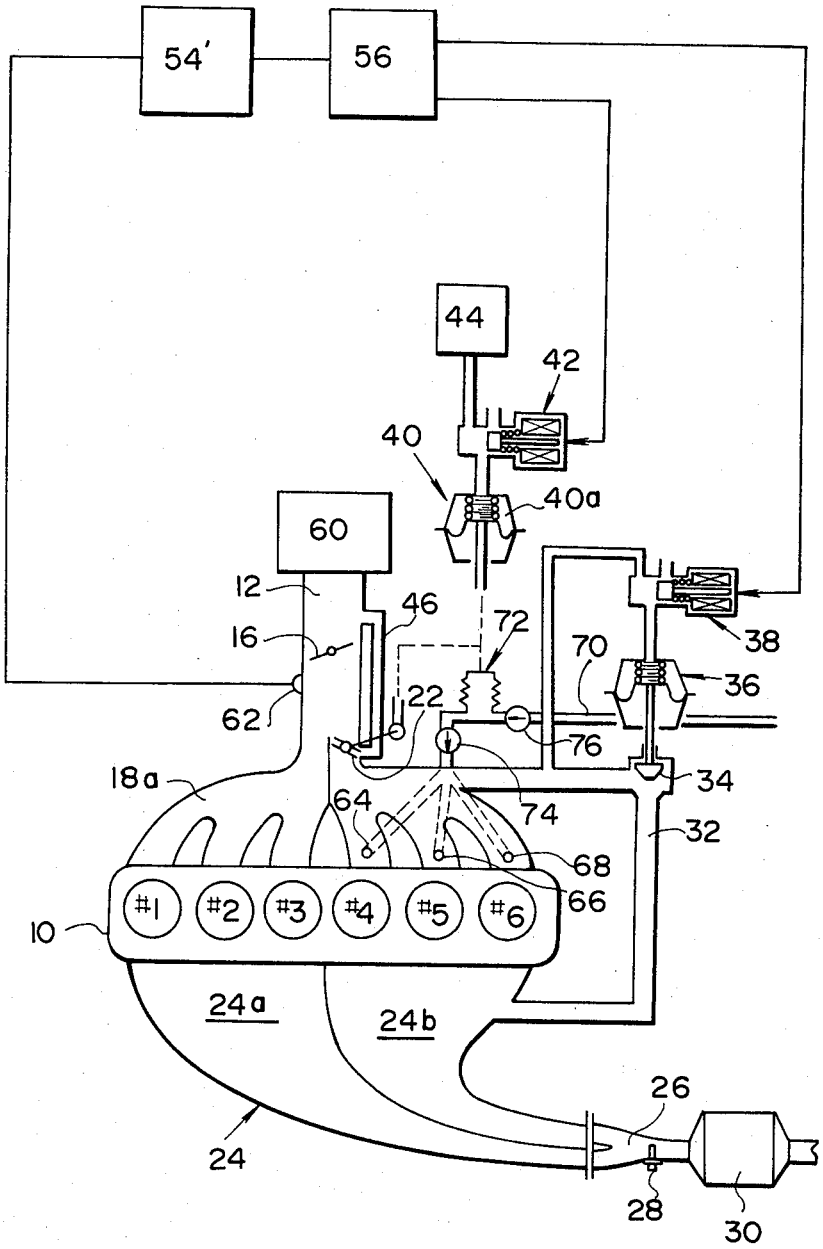
FIG. 2 is a schematic sectional view showing a second embodiment of the present invention.

Referring to FIG. 2, there is illustrated a second embodiment of the present invention. Parts in FIG. 2 which are like those in FIG. 1 have been given the same reference numeral. Parts which perform the same function but are slightly different in form have been given the same reference numeral with a suffix prime.

In this embodiment, the principles of the present invention are applied to a split multicylinder internal combustion engine of the type including a carburetor 60 for creating an air-fuel mixture of substantially stoichiometric air-fuel ratio. The carburetor 60 is connected to the induction passage 12 upstream of the throttle valve 16. A suction vacuum sensor 62 is provided for generating a signal indicative of the vacuum developed in the induction passage 12 somewhere downstream of the throttle valve 16. The suction vacuum indicative signal is fed from the suction vacuum sensor 62 to a split engine control circuit 54'. The split engine control circuit 54' is adapted to determine the engine load at which the engine is operating from the suction vacuum indicative signal. When the engine load is below a predetermined value, the split engine control circuit 54' provides a control signal to the drive circuit 56 which operates in the same manner as described in connection with FIG. 1.

Fuel injection nozzles 64, 66 and 68 are opened into the respective branches extending from the second intake passage 18*b* to the associated cylinders #4, #5 and #6. The fuel injection nozzles 64, 66 and 68 are connected through an auxiliary fuel passage 70 to a fuel reservoir (not shown). Connected to the auxiliary fuel passage 70 is a fuel pump 72 which is driven by the second valve actuator 40 to supply fuel to the fuel injection valves 64, 66 and 68. Check valves 74 and 76 are provided in the auxiliary fuel passage 70 downstream and upstream of the fuel pump 72, respectively, for preventing fuel flow toward the fuel reservoir. The remaining components are substantially the same as described in FIG. 1 except that the injection control circuit 50 is removed, hence no detailed description of it is provided.

Figure 3:
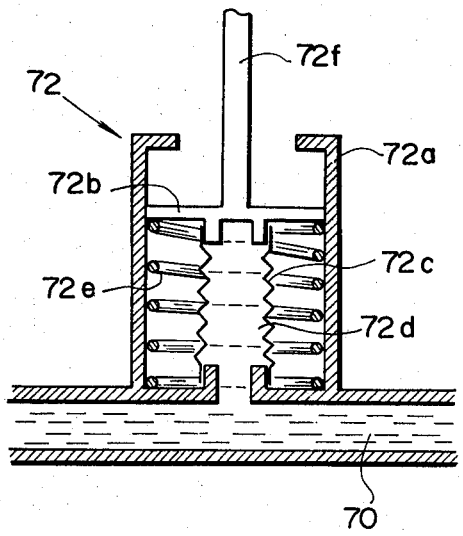
FIG. 3 is an enlarged sectional view showing the fuel pump used in the engine of FIG. 2.

As shown in FIG. 3, the fuel pump 72 comprises a housing 72*a* within which a piston 72*b* is adapted to reciprocate. A tubular bellows 72*c* is provided in the housing 72*a* to define, together with the inner surface of the piston 72*b*, a deformable chamber 72*d* which is communicated with the auxiliary fuel passage 70. The piston 72*b* is urged upward in the drawing to increase the volume of the chamber 72*d* by means of a spring 72*e*. The piston 72*b* is drivingly connected through a connection rod 72*f* to the second valve actuator 40 so that the piston 72*b* moves downward against the force of the spring 72*e* to reduce the volume of the chamber 72*d* when the second valve actuator 40 opens the stop valve 22 from its closed position.

When the engine operation is shifted from its full engine mode into its split engine mode, the piston 72*b* moves upward by the force of the spring 72*e* to cause the bellows 72*c* to suck fuel into the chamber 72*d* from the auxiliary fuel passage 70. When the engine operation is shifted from its split engine mode into its full engine mode, the piston 72*b* moves downward to cause the bellows 72*c* to discharge the fuel from the chamber 72*d* into the auxiliary fuel passage 70. The discharged fuel is supplied through the fuel injection nozzles 64, 66 and 68 into the branches leading to the associated cylinders #4, #5 and #6 for a predetermined period of time during which the pressure of the fuel discharged from the chamber 72*d* is sufficient to open the check valve 74. Thus, the cylinders #4 to #6 are supplied with an air-fuel mixture before the air-fuel mixture discharged from the carburetor 60 reaches the cylinders #4 to #6. This permits rapid shifting of the engine operation from its split engine mode into its full engine mode.

Although the fuel pump 72 has been described as driven by the second valve actuator 40, it is to be noted that any other suitable means may be used to operate the fuel pump 72. It is preferable to operate the fuel pump before the operation of the stop valve when rapid acceleration is required.

It is apparent from the foregoing that the split multicylinder internal combustion engine made in accordance with the present invention exhibits high engine performance particularly under acceleration with a greatly reduced time during which the engine operation is shifted from its split engine mode into its full engine mode after the engine load exceeds the predetermined value.

While the present invention has been described in connection with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) first and second cylinder units each including at least one cylinder;

(b) an induction passage having therein a throttle valve, said induction passage being divided, downstream of said throttle valve, into first and second intake passages leading to said first and second cylinder units, respectively;

(c) a normally open stop valve provided at the entrance of said second intake passage;

(d) control means responsive to conditions of engine load for closing said stop valve to disconnect said second intake passage from said induction passage when the engine load is below a predetermined value;

(e) a main fuel supply unit for supplying a controlled amount of fuel into said induction passage; and (f) an auxiliary fuel supply unit for supplying a predetermined amount of fuel into said second intake passage downstream of said stop valve for a predetermined period of time after the engine load exceeds the predetermined value.

2. An internal combustion engine according to claim 1, wherein said main fuel supply unit comprises fuel injection valve means opening into said induction passage downstream of said throttle valve, and wherein said control means controls the operation of said fuel injection valve means to supply a controlled amount of fuel in accordance with the load at which the engine is operating.

3. An internal combustion engine according to claim 2, wherein said auxiliary fuel supply unit comprises auxiliary fuel injection valve means opening into said second intake passage downstream of said stop valve, and wherein said control means controls the operation of said auxiliary fuel injection valve means to supply a predetermined amount of fuel for a predetermined period of time after the engine load exceeds the predetermined value.

4. An internal combustion engine according to claim 1, wherein said main fuel supply unit comprises a carburetor for creating an air-fuel mixture of substantially stoichiometric air-fuel ratio.

5. An internal combustion engine according to claim 4, wherein said auxiliary fuel supply unit comprises fuel injection nozzle means opening into said second intake passage downstream of said stop valve, said fuel injection nozzle means connected through an auxiliary fuel passage to a fuel reservoir, and a fuel pump provided in said auxiliary fuel passage for discharging a predetermined amount of fuel to said fuel injection nozzle means for a predetermined period of time after the engine load exceeds the predetermined value.

6. An internal combustion engine according to claim 5, wherein said fuel pump comprises a bellows having therein a deformable chamber communicated with said auxiliary fuel passage, said bellows drivingly connected to said stop valve to increase the volume of said chamber with the closing movement of said stop valve and to reduce the volume of said chamber with the opening movement of said stop valve, and a pair of check valves provided in said auxiliary fuel passage downstream and upstream of said bellows, respectively.

* * * * *